United States Patent [19]

Morris

[11] Patent Number: 4,864,659

[45] Date of Patent: Sep. 12, 1989

[54] SPORTS GLOVE

[75] Inventor: Stephen M. Morris, Scottsdale, Ariz.

[73] Assignee: GenCorp Inc., Fairlawn, Ohio

[21] Appl. No.: 265,103

[22] Filed: Oct. 31, 1988

[51] Int. Cl.[4] ..... A41D 19/00

[52] U.S. Cl. ..... 2/161 A; 2/20; 2/163

[58] Field of Search ..... 2/16, 20, 159, 160, 2/161 R, 161 A, 163

[56] References Cited

U.S. PATENT DOCUMENTS

| | | | |
|---|---|---|---|
| 3,123,832 | 3/1964 | Kubik | 2/161 A |
| 3,348,238 | 10/1967 | Hydock | 2/161 A |
| 3,882,548 | 5/1975 | Shinagawa et al. | 2/161 A |
| 4,071,913 | 2/1978 | Rector | 2/161 A X |
| 4,525,877 | 7/1985 | Chong | 2/161 A |
| 4,570,269 | 2/1986 | Berlese | 2/161 A |

FOREIGN PATENT DOCUMENTS

| | | | |
|---|---|---|---|
| 3516545 | 11/1985 | Fed. Rep. of Germany | 2/16 |
| 649632. | 1/1951 | United Kingdom | 2/16 |

*Primary Examiner*—Werner H. Schroeder
*Assistant Examiner*—Sara M. Current

[57] ABSTRACT

A sports glove is described for playing the game of handball or racquetball. The glove is uniquely padded to protect the topsides of the little finger and adjacent ring finger, because it has been found that this particular side of these two fingers are most likely to contact the floor or walls of a playing court when a player makes a diving attempt to return a shot, or when hitting a ball in close proximity to one of the walls of the court. The padding is formed of a soft cushioning material for absorbing the shock upon contact with a wall or floor. The padding of the little finger can be extended to cover the main knuckle between the little finger and palm of a person wearing the glove.

12 Claims, 1 Drawing Sheet

SPORTS GLOVE

BACKGROUND OF INVENTION

The invention ralates to protective gloves that are used in playing sports, especially handball or racquetball, both of which are played indoors in an enclosed court formed of a resilient, rectangular wood floor that is surrounded by four upstanding hard surfaced walls consisting of a front wall and opposing back wall which are connected by a pair of opposing sidewalls, all of which are covered by a high, well illuminated ceiling. Both the racquetball and handball courts are relatively small compared to other indoor courts such as those used in the playing of tennis or basketball. In handball, either hand may be skillfully used to strike a small, lively rubber ball, whereas the game of racquetball is played with a small, stringed racket.

In highly competitive matches, it is not uncommon for players to dive across the floor or crash into one of the sidewalls in an effort to return a shot from an opponent. Anyone watching such a match soon realizes that the play is fast and furious. The players of such matches perspire profusely as they move swiftly about the court, making it almost mandatory to wear some type of glove to either strike the ball or hold the racquet securely and prevent it from slipping from one's grasp.

Athletic or sports gloves currently worn by handball and racquetball players are similar to those worn in golf, tennis or baseball. Such gloves generally comprises, (I) a soft, pliable leather which covers the palm of the hand, (II) a similar leather or non-leather, porous material which covers the top or back of the hand, (III) a split elastic-type wristband and (IV) VELCRO a hook and pile fastener of the type sold under the trademark for tightening the wristband firmly about the wrist of a player. U.S. Pat. Nos. 4,071,913 and 4,525,877 are typical of the patents relating to such sports gloves.

This sports glove is fine for hitting the ball or gripping the racquet, but provides little or no protection for the back of a player's hand should it strike the floor or one of the walls while making particular difficult shot. The invention is designed to provide such protection.

Briefly stated, the invention is in such a sports glove, and comprises placing shock-absorbing padding in the back of the glove to cover essential portions of the small finger and adjacent ring finger which are the two fingers found most likely to come in contact with the floor or walls of a handball or racquetball court.

DESCRIPTION OF DRAWING

The following description of the invention will be better understood by having reference to the accompanying drawing, wherein.

Environment of Invention

Figure 1:
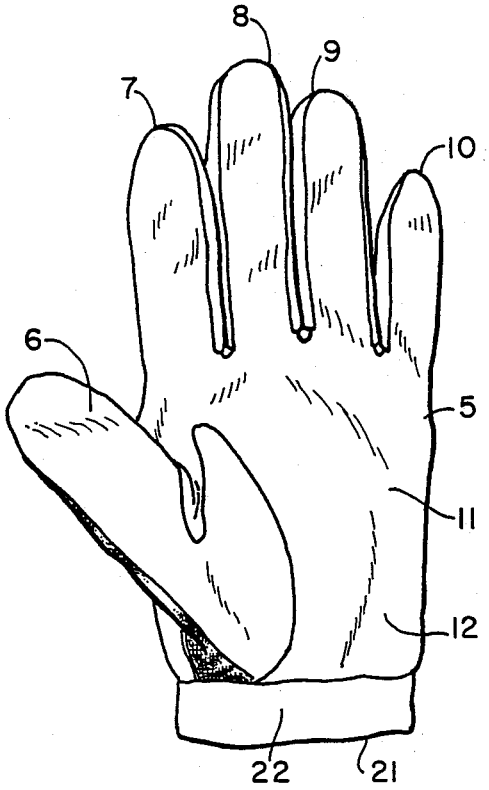
FIG. 1 is a plan view of the front or palm side of a sports glove which is made in accordance with the invention.

With general reference to the drawing, there is shown a sports glove 5 which, in this instance, is designed to cover the left hand of a player who is participating in the sport of handball or racquetball. The sports glove 5 is hand-shaped and includes a thumb 6, an index finger 7, a middle finger 8, a ring finger 9, and a little finger 10 for covering corresponding fingers and thumb of a human hand.

Figure 2:
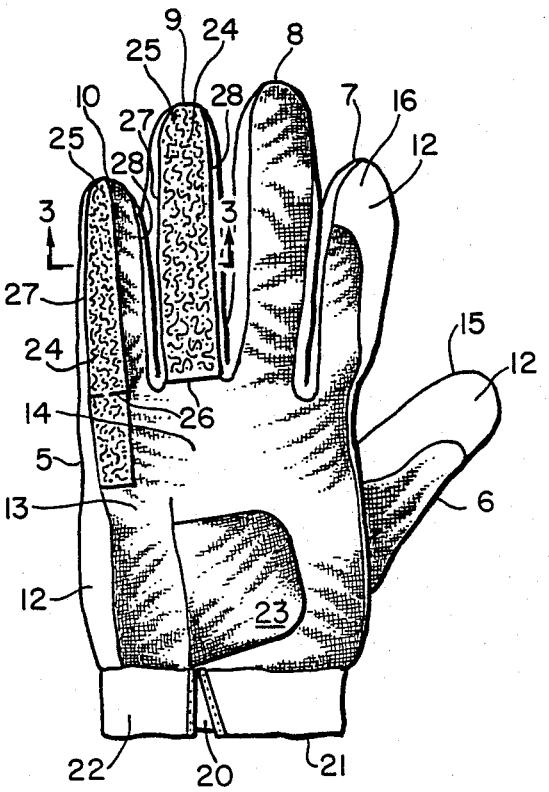
FIG. 2 is a similar view of the back or top side of the glove.

The front or palm side 11 of the glove 5 which covers the palmar surface of a hand, as best seen in FIG. 1, is composed of a soft, pliable, relatively inextensible wear-resistant material 12, such as leather, e.g. pigskin, goatskin, or sheepskin. The oppositely disposed and matingly configured back or top side 13 of the glove 5 which covers the opposing dorsal surface of the hand, as best seen in FIG. 2, can be composed of a porous, extensible material 14, such as terry cloth, nylon mesh, or the type of spendex material sold under the trademark LYCRA. The back 13 of the glove 5 can, alternately, be made of the same material 12 as the front 11 of the glove 5. If necessary, breather holes or openings (not shown) can be provided in the glove 5, especially when the front 11 and back 13 of the glove 5 are made of leather.

When the back 13 of the glove 5 is made of nylon mesh 14 or similar material, it is advisable to place leather 12 on the back 13 of the tips 15, 16 of the thumb and index finger to reinforce these areas, since they are susceptible to excessive wear in holding a racquet. Leather 12 can also be placed around the side of the glove 5 opposite the thumb 6 to cover the corresponding side of the palm of the hand, since this area is also subject to wear.

The back 13 of the glove 5, is provided with a slit 20 which extends inwardly of the back 13 from an opening 21 through which a hand enters the glove 5. The slit 20 is provided to permit enlarging the opening 21 for easy entry of a hand into the glove 5. An elastic wristband 22 is secured around the opening 21, the continuity of the wristband 22 being interrupted by the slit 20.

Any suitable means 23, e.g. a VELCRO-type fastener, is provided on opposing sides of the slit 20 to hold the sides and opposing ends of the wristband 22 in overlapped relation, whereby the wristband 22 is tightened around a player's wrist after the player's hand is placed in the glove 5.

THE INVENTION

Figure 3:
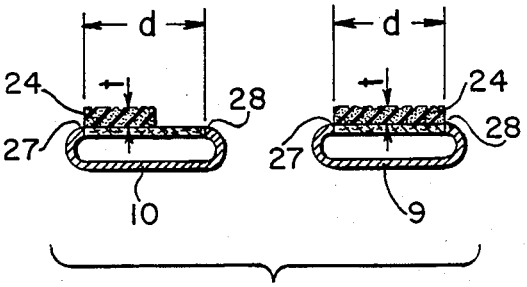
FIG. 3 is a section of the glove viewed from the line 3—3 of FIG. 2.

The back 13 of the glove 5 covering the ring finger 9 and adjacent little finger 10, is provided with similar padding 24 for protecting the corresponding tops of these two fingers which are susceptible to injury upon contacting the floor when making diving shots, or upon contacting a wall when striking a ball in close proximity to the wall. The padding 24 is composed of any suitable, non-leather, soft cushioning or shock absorbing material, such as cotton, terry cloth, and natural or synthetic foams or fibers having a thickness t (FIG. 3) in the range of from 0.04 inches to 0.25 inches. The padding 24 is co-extensive with each finger and helps prevent injury of the distal, middle and proximal phalanx bones of the ring finger 9 and little finger 10, as well as the joints between these bones should they come in contact with the hard floor and walls of the racquetball court.

The padding 24 of each of these two fingers 9, 10 extends longitudinally of the finger between the distal and proximal ends 25, 26 of the finger, and should be at least 10% of the distance d between the opposing longitudinal marginal edges, 27, 28 of the finger, measured from the marginal edge 27 farthest from the middle finger 8 in the direction of the opposing marginal edge 28, midway between the distal and proximal ends 25, 26 of each of the two fingers 9, 10, to provide minimal protection for these fingers. For maximum protection, the backs 13 of these fingers 9, 10 should be completely covered with padding 24 which can be secured outside the fingers 9, 10, or within the fingers 9,10, providing the fingers are enlarged to accomodate this padding 24. For illustration purposes, FIGS. 2 and 3 have been drawn to show 50% padding coverage of the little finger 10 and 100% padding coverage of the ring finger 9.

The padding 24 of the little finger 10 extends from the proximal end 26 of the little finger 10 towards the glove opening 21 a distance sufficient to cover and protect the metacarpal-phalangeal (MCP) joint or knuckle of the little finger of a person wearing the glove, since it has been found that this knuckle is more likely to contact a wall or floor than other knuckles of the hand.

Thus, there has been described a unique sports glove which is especially useful in playing the fast, action-packed games of handball and racquetball. The glove employs shock-absorbing padding which is located on the back of the glove and which is at least coextensive with the length of the little finger and the adjacent ring finger of the glove, unlike prior art gloves which have specially padded palms or index fingers for engaging a special racquet with which the game is played.

What is claimed is:

1. A sports glove used to protect the hand of a player while playing a sport such as handball or racquetball, the glove being hand-shaped having a thumb, an index finger, a middle finger, a ring finger, a little finger, a front side for covering the palmar suface of a hand, and a back for covering the top dorsal surface of the hand, the glove comprising non-leather like, soft cushioning padding located only on the back of the ring and little fingers at least between the distal and proximal ends of the fingers.

2. The sports glove of claim 1, wherein the padding of each finger, measured from the longitudinal marginal edge of the finger farthest from the middle finger, covers at least 10% of the distance (d) between the marginal edge and opposing marginal edge measured midway between the distal and proximal ends of the finger.

3. The sports glove of claim 2, wherein the padding of the little finger extends from the proximal end thereof a distance sufficient to cover at least a portion of the MCP joint of the little finger of a person wearing the glove.

4. The sports glove of claim 2, wherein the thickness (t) of the padding is between 0.04 inches and 0.25 inches.

5. The sports glove of claim 4, wherein the padding is of the group of materials of cotton, terry cloth, natural and synthetic foams and fibers.

6. The sports glove of claim 5, wherein the front side of the glove is composed of leather-like material.

7. The sports glove of claim 6, wherein the back of the glove is composed of similar leather-like material.

8. The sports glove of claim 6, wherein the back of the glove is composed of porous, extensible material of the group of materials of terry cloth, nylon mesh and LYCRA.

9. A sports device used in playing the sport of handball and racquetball, comprising:

a hand-shaped glove including a thumb, an index finger, a middle finger, a ring finger and a little finger for covering a corresponding thumb and fingers of a hand, the glove having a front side for covering the palmar surface of a hand and a back side for covering the dorsal side of the hand;

the front side of the glove being composed of an inextensible, soft, pliable leather-like material;

the back side of the glove being composed of a porous, extensible synthetic material of the group of materials of nylon mesh, terry cloth, and LYCRA;

non-leather-like, soft cushioning padding at least covering a portion of the back side of the little finger and ring finger only, the padding being at least coextensive with the length of each of the two fingers and extending from the longitudinal marginal edge of each of the two fingers farthest spaced from the middle finger in the direction of the opposing longitudinal marginal edge closer the middle finger, the padding being of the group of materials of cotton, terry cloth, and natural and synthetic foams and fibers, the padding having a thickness (t) of from 0.04 inches to 0.25 inches and covering at least 10% of the distance (d) between opposing marginal edges of each of the two fingers;

the glove having an opening through which a hand is placed in the glove, the back side of the glove having a slit which extends from the opening towards the fingers to enlarge the opening for easy entry of the hand into the glove;

an elastic wristband secured around the opening of the glove and having its continuity interrupted by the slit; and means coacting between opposing sides of the slit for holding the sides firmly together to tighten the glove on a hand after entry into the glove.

10. The sports glove of claim 9, wherein the padding of the little finger extends therefrom a distance sufficient to cover at least a portion of the MCP joint of the little finger of a person wearing the glove.

11. A sports device used in playing the sport of racquetball, comprising:

a hand-shaped glove including a thumb, an index finger, a middle finger, a ring finger, and a little finger for covering a corresponding thumb and fingers of a hand, the glove having a front side for covering the palmar surface of a hand and a back side for covering the dorsal side of the hand;

the front and back sides of the glove being composed of an inextensible, soft, pliable leather-like material;

non-leather-like, soft, cushioning padding at least covering a portion of the back side of the little finger and ring finger only, the padding being coextensive with the length of each of the two fingers and extending from the longitudinal marginal edge of each of the two fingers farthest spaced from the middle finger in the direction of the opposing longitudinal marginal edge closer the middle finger, the padding being of the group of materials of cotton, terry cloth, and natural and synthetic foams and fibers, the padding having a thickness (t) of from 0.04 inches to 0.25 inches and covering at least 10% of the distance (d) between opposing marginal edges of each of the two fingers;

the glove having an opening through which a hand is placed in the glove, the back side of the glove having a slit which extends from the opening towards the fingers to enlarge the opening for easy entry of the hand into the glove;

an elastic wristband secured around the opening of the glove and having its continuity interruped by the slit; and means coacting between opposing sides of the slit for holding the slides firmly together to tighten the glove on a hand after entry into the glove.

12. The sports glove of claim 11, wherein the padding of the little finger extends therefrom to cover at least a portion of the MCP joint of the little finger of a person wearing the glove.

* * * * *